United States Patent [19]

Marsh

[11] Patent Number: 4,918,844

[45] Date of Patent: Apr. 24, 1990

[54] MAINTAINING AN ICE RINK ADJACENT A SIDE EDGE

[76] Inventor: Frederick J. Marsh, 3 Dunn Street, Kitimat, British Columbia, Canada, V8C 1C6

[21] Appl. No.: 379,986

[22] Filed: Jul. 14, 1989

[51] Int. Cl.[5] ..... E01H 5/10; F23C 5/14

[52] U.S. Cl. ..... 37/197; 37/227; 37/230; 126/271.2 R

[58] Field of Search ..... 37/219, 227, 228, 230, 37/197; 126/271.1, 271.2 R, 271.2 A

[56] References Cited

U.S. PATENT DOCUMENTS

| | | | |
|---|---|---|---|
| 636,987 | 11/1899 | Hendryx | 37/227 |
| 1,203,531 | 10/1916 | Givens | 126/271.2 C |
| 1,515,553 | 11/1924 | Cummings | 37/227 |
| 1,526,903 | 2/1925 | Connolly | 37/227 X |
| 1,837,030 | 12/1931 | Elze | 126/271.2 B |
| 2,977,695 | 4/1961 | Kesecker | 37/230 |
| 3,291,118 | 12/1966 | Wilson | 126/271.2 C |

FOREIGN PATENT DOCUMENTS

| | | | |
|---|---|---|---|
| 692617 | 8/1964 | Canada | 37/227 |
| 2277938 | 2/1976 | France | 37/227 |

*Primary Examiner*—Randolph A. Reese
*Assistant Examiner*—Arlen L. Olsen
*Attorney, Agent, or Firm*—Adrian D. Battison; Stanley G. Ade; Murray E. Thrift

[57] ABSTRACT

Resurfacing or conditioning of the ice surface of an ice rink in the area adjacent the edge of the ice and the kickboards defining the edge of the ice is carried out by a burner unit which applies a propane flame in a direction downwardly onto the ice in an area confined by a metal guide surrounding the flame. The unit melts the ice on the board and at the edge to prevent ice build up using a simple economic construction on a device which produces little or no toxic fumes.

17 Claims, 2 Drawing Sheets

MAINTAINING AN ICE RINK ADJACENT A SIDE EDGE

BACKGROUND OF THE INVENTION

This invention relates to an apparatus and method for maintaining an ice rink of the type used for sporting activities comprising a horizontal ice surface and a substantially vertical side edge defining an edge of the ice surface Such side edges generally include vertical boards, for use in such games as ice hockey, which extend upwardly from the ice surface.

Conventionally the horizontal ice surface is maintained by a conditioning or resurfacing machine of the type which includes a scraper mechanism which lifts or scrapes off an upper layer of the ice surface, together with a flooding device which releases a thin layer of water over the scraped ice surface so the water can freeze and form a fresh surface layer which is free from gouges and cracks caused by skaters' blades. These resurfacing machines have been available for many years and one example of the machines of this type is known as a Zamboni machine which is a self propelled vehicle especially designed for this purpose.

One problem which has been difficult to resolve for many years is that of conditioning or resurfacing the ice immediately adjacent the edge of the ice at the vertical boards and on the boards themselves. Generally, the conventional conditioning machine cannot reach the edge strip of the ice within distance of the order of six inches from the boards and this tends to generate a buildup of ice at the boards and on the boards requiring separate attention. This is exacerbated by the tendency of the skaters to stop vigorously against the boards thus throwing up a shower of ice particles.

A hand conditioning machine is available and is used in situations, for example professional games, where the ice condition must be maintained in the best possible state. The hand conditioning machine comprises a motor driven rotatable blade similar to a reel type mowing machine where the blade rotates about a horizontal axis and scrapes the upper surface adjacent the boards. This is then followed by the conventional conditioning machine which removes the ice particles scraped away from the boards and then refloods the ice surface. However these hand push devices do not fully resolve the problem and there tends to remain a buildup of ice in this area. In particular, this type of device can do nothing to the ice carried on and built up on the boards and generally this has to be removed by hand.

At the present time it is believed that no alternative equipment is available or is being proposed for solution of this particular problem.

Various devices have been proposed for heating various metal surfaces of a snowplow or snowblade type device in which a user pushes a blade or other surface against a layer of snow. Examples of these devices are shown in U.S. Pat. Nos. 2,977,695 (Kesecker), 636,987 (Hendryx), 1,515,553 (Cummings), 1,203,531 (Givens), 1,837,030 (Elze), 1,526,903 (Connolly) and 3,291,118 (Wilson). The last of these patents generates a stream of heated air using a fan and a flame burner so the air is driven past the flame and is heated thereby with the air being driven forwardly at a shallow angle to the ground to attempt to blow snow away from the ground. None of these devices is however in any way concerned with the problem of maintaining the proper smooth horizontal condition of the ice surface of an ice rink.

Canadian patent no: 692,617 (Dunn) discloses an ice conditioning machine which uses heat to melt the surface rather than conventional scraping and flooding techniques. However this device is intended to replace the conventional conditioning machine and hence operates in a wide band concentrating on the majority of the ice surface and is ineffective adjacent the edge of the ice surface since the heat cannot reach this area in view of the presence of the castor wheels supporting the device. The problems concerning the edge therefore remain without solution. SUMMARY OF THE INVENTION It is an object of the present invention, therefore, to provide a device for use in maintaining the ice surface of an ice rink particularly adjacent the edge of the ice.

According to the first aspect of the invention, therefore, there is provided a method of maintaining an ice rink of the type used for sporting activities comprising a horizontal ice surface and a substantially vertical side surface defining an edge of the ice surface, the method comprising applying heat to the ice surface solely adjacent the edge so as to cause melting of the ice at the edge, and moving the application of heat along the edge so as to apply the heat in a narrow strip along the edge.

According to the second aspect of the invention there is provided the method of maintaining an ice rink of the type used for sporting activities comprising a horizontal ice surface and a substantially vertical side surface defining an edge of the ice surface, the method comprising directing a flame onto the ice surface adjacent the edge so the contact of the flame on the ice surface causes melting of ice at the edge, and moving the flame along the edge so as to cause melting of ice in a narrow strip along the edge.

According to a third aspect of the invention there is provided apparatus for maintaining an ice rink of the type used for sporting activities comprising a horizontal ice surface and a substantially vertical side surface defining an edge of the ice surface, the apparatus comprising frame means, means for transporting the frame means around the ice surface at the edge, and means mounted on the frame means for generating a flame from a combustible material and for directing the flame onto the ice surface adjacent the edge so as to apply heat thereto in a narrow strip along the edge.

For the first time, therefore, the present inventor is proposing an arrangement in which a specific heating device is provided for heating a narrow strip of the rink immediately adjacent the boards of the rink. In the particularly preferred arrangement, the heating is carried out by a flame directly applied to the surface with that flame being confined by a guard surface which extends close to the ice at the edge so that the flame can apply sufficient heat to the ice surface without causing flame damage on the boards or without allowing the flame to spread freely over the ice surface thus reducing the direct effect on the ice at the boards.

The device can be mounted upon a simple hand cart and used by the rink attendant or an assistant prior to the conventional use of the ice resurfacing machine. Alternatively the device can be mounted upon a front corner of the ice resurfacing machine so that it acts upon the ice automatically as the machine makes a first run around the boards with the ice conditioning portion of the resurfacing machine trailing behind the device of the present invention.

With the flame guard arrangement spaced slightly above the ice surface, the flame can properly operate upon the ice surface itself and also upon the junction between the ice surface and the board (generally known as a kick-board) so that any ice build up in this area is properly removed.

The burning of propane as the heat source enables the heat to be generated with little or no noxious fumes since the flame is freely burned in an adequate supply of oxygen. Hence the device does not contribute to the problem of the collection of noxious gases which, as is well known, tend to collect in the area from ice level up to six feet above the ice surface which is exactly the area where it is most vigorously breathed by the sport participants.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different figures.

DETAILED DESCRIPTION

Figures 1, 2:
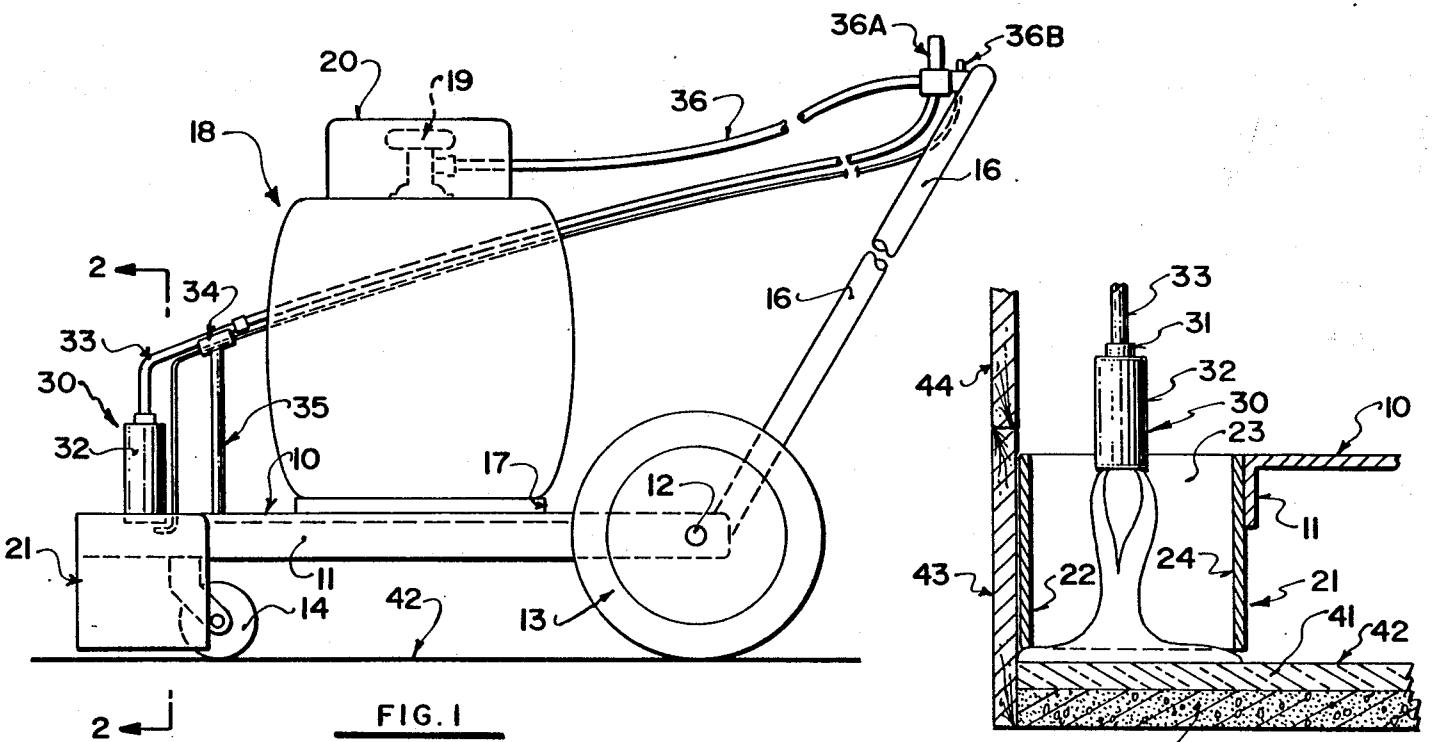
FIG. 1 a side elevational view of an ice surfacing machine according to the invention.
FIG. 2 is a view along lines 2—2 of FIG. 1.

The apparatus as shown in FIG. 1 comprises a substantially flat platform 10 defined by an upper rectangular plate and a downturned flange 11 surrounding the plate. An axle 12 extends through the portion of the flange on the sides of the plate in a position adjacent the rear of the upper plate and carries a pair of wheels 13 one on either side of the plate to rollingly support the rear edge of the platform. A front caster wheel 14 is mounted under the forward part of the platform substantially centrally on a suitable support plate 15. A handle structure 16 extends rearwardly from the platform adjacent the rear wheel 13 up to a horizontal cross bar at a suitable height so the platform can be pushed across the ground by a user.

A conventional propane tank is mounted on the platform and is located in place by a suitable clamping arrangement 17. The tank is indicated at 18 and is in the preferred arrangement simply a conventional 20 pound propane tank which has a release valve 19 at the upper end mounted in a guard 20.

Figure 3:
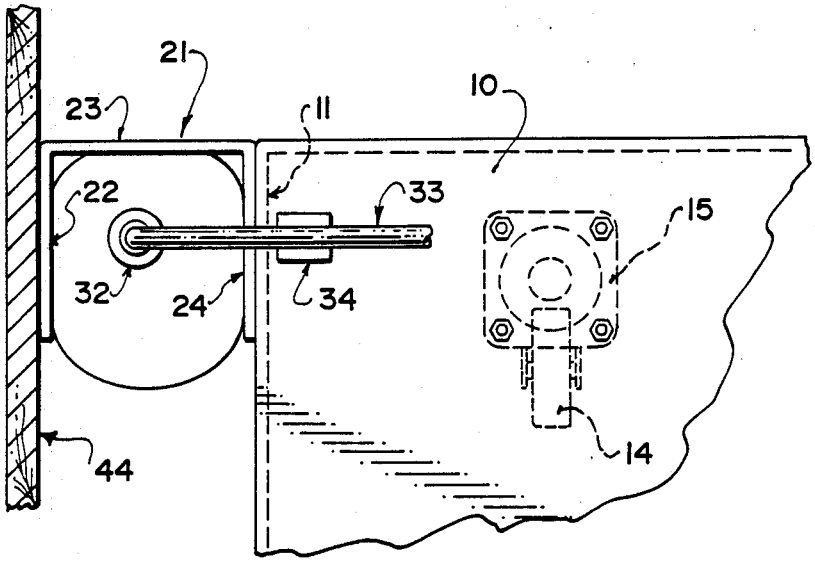
FIG. 3 is a top plan view of a portion of the ice surfacing machine of FIG. 1.

As best shown in FIG. 3 attached to one side of the platform 10 is a shroud mechanism 21 which comprises three vertical walls 22, 23 and 24 formed from a single sheet of metal of a suitable thickness bent along two vertical fold lines to define a rectangular container section with an open rear, an open base and an open top surface. The side 24 is suitably attached to the platform for example by welding to the flange 11. The height of the vertical walls 22, 23 and 24 is such that they extend from the upper edge of the platform 10 to a position closely adjacent but slightly spaced from the ground by distance of the order of one-quarter inch. The width of the shroud member is preferably of the order of 3 to 4 inches and certainly less than 12 inches.

A conventional propane torch is indicated at 30 which includes a jet nozzle 31, a shroud 32 and an inlet line 33. The inlet line 33 is rigid and is supported on a bracket 34 carried on a post 35 supported on the platform 10. The position of the torch is such that the bottom end of the shroud just extends inside the open upper surface of the rectangular container defined by the walls 22, 23 and 24. The nozzle is arranged on a vertical axis so that it directs the flame vertically downwardly toward the ice surface. The nozzle is positioned substantially centrally inside the rectangular shroud area defined by the walls 22, 23 and 24.

A flexible hose line 36 is connected from the valve 19 to the rigid supply line 33. The hose line 36 extends from the valve 19 to a control valve 36A mounted suitably on the handle 16 at a position at which it can be operated manually by the operator pushing the device. An igniter 36B is also positioned on the handle for spark ignition of the flame.

As best shown in FIG. 2, the flame generated by the burner 30 extends downwardly inside the area defined by the walls 22, 23 and 24.

The ice rink with which the device is used is also shown in FIG. 2 and comprises a concrete layer 40 and an ice layer 41 laid on top of the concrete layer and defining a smooth upper surface 42. The one side edge of the ice layer is defined a vertical side edge in the form of a kick-board 43 which forms part of the rink board structure generally indicated at 44.

In general use the ice from the layer 41 tends to form onto the kick-board 43 at the junction between the ice surface and the kick-board and partly up the kick-board.

As shown in FIG. 2, the flame from the torch 30 projects downwardly and engages the ice surface and spreads over the ice surface into the junction between the ice surface and the board 43. This causes vigorous melting of the ice in this area. The outer vertical wall 22 is arranged to run against the kickboard 43 so that its height is equal to or slightly less than that of the kick-board. The heat from the flame is sufficient to cause the ice immediately adjacent the kickboard to melt at the ice surface but of course the main body of the ice layer 41 remains unmelted. The heat from the flame is confined basically by the vertical walls 22, 23 and 24 of the shround so that it acts in a narrow band around the edge of the kick-board.

As the burner device is mounted upon the hand cart, it can be readily pushed by the ice attendant or an assistant around the boards with the outer vertical wall 22 of the shroud running in contact with the kick-board so that the heat from the wall causes melting of the ice. Subsequently with the ice in this area melted, the ice can be resurfaced by the conventional resurfacing machine of the Zamboni or other suitable type.

As is known, the flooding section of the resurfacing machine reaches up to the boards but the scraper section cannot thus tending in the conventional use to cause a buildup at the edge. In this case, the additional removal of ice at the edge avoids this buildup or over flooding effect.

Figure 4:
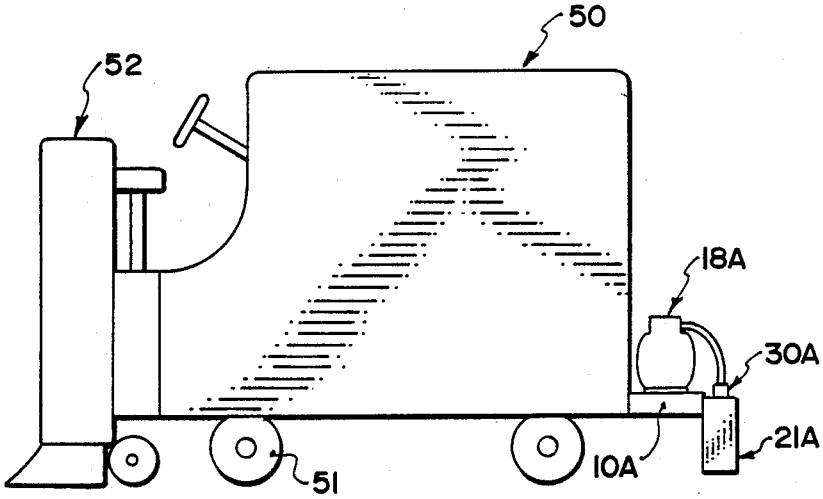
FIG. 4 is a schematic illustration of an alternative embodiment of the invention mounted upon a conventional ice resurfacing machine.

In FIG. 4 there is shown very schematically a Zamboni machine 50 of the conventional type which is a self propelled vehicle mounted on ground wheels 51. At the rear of the vehicle is mounted the scraper and flooding assembly generally indicated at 52. At the front end of the vehicle adjacent one front corner is mounted a platform 10A of a construction similar to that of the platform 10 except that the wheels are omitted. The platform carries a source of a combustion material generally propane indicated at 18A together with a burner 30A and a shroud 21A of the type previously described. The device can thus be transported around the boards by a first pass of the Zamboni machine with the ice scraper and flooding arrangement operating on the ice subsequent to the operation of the burner unit previously described.

The ice burner/edger of the present invention enables the ice on the kick-boards and also the ice at the edge of the ice surface to be properly resurfaced and any ice build up is removed. The device has no moving parts and accordingly is simple to maintain and will have a long life. The fumes from the device are very limited in quantity relative to the conventional internal combustion engine type devices used on ice resurfacing equipment and are non-toxic in view of the complete combustion which is available.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of maintaining an ice rink of the type used for sporting activities comprising a horizontal ice surface and a substantially vertical side surface defining an edge of the ice surface, the method comprising applying heat to the ice surface solely adjacent the edge so as to cause melting of the ice at the edge, and moving the application of heat along the edge so as to apply the heat in a narrow strip along the edge.

2. The invention according to claim 1 wherein the heat is applied by directing a flame of a combustible material so that the flame directly contacts the ice surface.

3. The invention according to claim 2 including providing a shroud member between the flame and the side surface.

4. The invention according to claim 3 wherein the shroud member is shaped to confine the flame to said narrow strip.

5. The invention according to claim 2 wherein the flame is formed by the combustion of propane.

6. The invention according to claim 1 wherein the narrow strip has a width less than one foot.

7. The invention according to claim 1 including the step of subsequently to the application of heat at the edge, resurfacing the ice surface using a conventional ice resurfacing machine having a working width wider than that of the narrow strip.

8. A method of maintaining an ice rink of the type used for sporting activities comprising a horizontal ice surface and a substantially vertical side surface defining one edge of the ice surface, the method comprising directing a flame onto the ice surface adjacent the edge so the contact of the flame on the ice surface causes melting of ice at the edge, moving the flame along the edge so as to cause melting of ice in a narrow strip along the edge and subsequently conditioning the ice surface using an ice conditioning machine having a working width wider than that of the narrow strip.

9. The invention according to claim 8 including providing a shroud member between the flame and the side surface.

10. The invention according to claim 9 wherein the shroud member is shaped to confine the flame to said narrow strip.

11. The invention according to claim 8 wherein the narrow strip has a width less than one foot.

12. The invention according to claim 8 wherein the flame is formed by the combustion of propane.

13. Apparatus for maintaining an ice rink of the type used for sporting activities comprising a horizontal ice surface and a substantially vertical side surface defining an edge of the ice surface, the apparatus comprising frame means, means for transporting the frame means around the ice surface at the edge, means mounted on the frame means for generating a flame from a combustible material and for directing the flame onto the ice surface adjacent the edge so as to apply heat thereto and a shroud member comprising a plurality of substantially vertical walls including a front wall and two side walls leaving an open base therebetween, at least one vertical side wall of the shroud member being arranged such that it is in use spaced from the ice surface by a short distance to allow the flame to extend under the side wall to said side surface.

14. The invention according to claim 13 wherein the side walls are spaced by a distance less than one foot.

15. The invention according to claim 13 including a source of propane for forming the flame.

16. The invention according to claim 13 wherein the transporting means comprises a hand movable cart assembly having a pair of wheels rotatable about an axis, said vertical shroud walls being spaced from said axis such that the shroud walls lie closely adjacent the ice surface.

17. The invention according to claim 13 wherein the frame means comprises means for mounting on a conventional ice resurfacing machine.

* * * * *